US011415339B2

(12) United States Patent
Nath et al.

(10) Patent No.: US 11,415,339 B2
(45) Date of Patent: Aug. 16, 2022

(54) HVAC FILTER LOCKING SYSTEMS AND METHODS

(71) Applicant: Johnson Controls Technology Company, Auburn Hills, MI (US)

(72) Inventors: Nivedita Nath, Pune (IN); Siddappa R. Bidari, Pune (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 293 days.

(21) Appl. No.: 15/916,098

(22) Filed: Mar. 8, 2018

(65) Prior Publication Data

US 2018/0347852 A1 Dec. 6, 2018

Related U.S. Application Data

(60) Provisional application No. 62/512,599, filed on May 30, 2017.

(51) Int. Cl.

| | |
|---|---|
| ***F24F 13/28*** | (2006.01) |
| ***F24F 13/20*** | (2006.01) |
| ***F24F 13/02*** | (2006.01) |

(52) U.S. Cl.

CPC ..... *F24F 13/28* (2013.01); *F24F 13/0254* (2013.01); *F24F 13/20* (2013.01)

(58) Field of Classification Search

CPC ..... F24F 13/28; F24F 13/20; F24F 13/0254
USPC ..... 454/330
See application file for complete search history.

(56) References Cited

U.S. PATENT DOCUMENTS

| | | | | |
|---|---|---|---|---|
| 3,707,046 | A * | 12/1972 | De Baun | B01D 46/12 55/483 |
| 3,925,043 | A * | 12/1975 | Matrone | B01D 46/523 96/136 |
| 4,171,211 | A * | 10/1979 | Carter | B01D 46/10 55/493 |
| 4,193,844 | A * | 3/1980 | Neumann | B01D 46/0094 55/309 |
| 4,601,737 | A * | 7/1986 | Gerbig | B01D 46/002 55/493 |
| 4,620,869 | A * | 11/1986 | Goossens | B01D 46/0004 454/296 |
| 5,232,277 | A * | 8/1993 | Cassady | E05D 5/065 16/221 |
| 5,863,310 | A | 1/1999 | Brown et al. | |
| 6,264,713 | B1 | 7/2001 | Lewis, II | |
| 6,502,909 | B1 * | 1/2003 | Swilik, Jr. | B01D 46/0002 312/257.1 |
| 6,902,603 | B2 | 7/2005 | Wiser, III et al. | |
| 7,931,726 | B2 | 4/2011 | Karlsson et al. | |
| 7,947,101 | B2 | 5/2011 | Devine et al. | |
| 8,413,833 | B1 * | 4/2013 | Taylor | H05K 5/0221 220/305 |
| 9,084,955 | B2 | 7/2015 | Woolard | |

(Continued)

*Primary Examiner* — Allen R. B. Schult
(74) *Attorney, Agent, or Firm* — Fletcher Yoder, P.C.

(57) ABSTRACT

In an embodiment of the present disclosure, a filter housing system of a heating, ventilating, and air conditioning (HVAC) system includes an enclosure configured to support a filter, a connecting channel disposed within a corner of the enclosure and coupled to the enclosure, and a locking system configured to couple to the connecting channel and configured to secure the filter within the enclosure. The locking system is configured to secure the filter within the enclosure via rotation of a screw.

16 Claims, 8 Drawing Sheets

(56) References Cited

U.S. PATENT DOCUMENTS

| | | | | |
|---|---|---|---|---|
| 10,359,212 | B2 * | 7/2019 | Darby | F24F 1/027 |
| 2009/0183463 | A1 * | 7/2009 | Osborn | F16B 2/065<br>52/745.21 |
| 2009/0249717 | A1 * | 10/2009 | Helmus | E04B 9/064<br>52/220.6 |
| 2010/0015904 | A1 * | 1/2010 | Yeh | B01D 46/10<br>454/184 |
| 2010/0251678 | A1 * | 10/2010 | Mann | F02C 7/052<br>55/483 |

* cited by examiner

HVAC FILTER LOCKING SYSTEMS AND METHODS

CROSS REFERENCE TO RELATED APPLICATION

This application is a Non-Provisional Application claiming priority to U.S. Provisional Application No. 62/512,599, entitled "UNIQUE HEPA FILTER LOCKING ARRANGEMENT FOR ROOFTOP UNIT," filed May 30, 2017, which is hereby incorporated by reference in its entirety for all purposes.

BACKGROUND

The present disclosure relates generally to heating, ventilating, and air conditioning (HVAC) systems and, more particularly, to systems and methods for securing a filter within an HVAC system.

A wide range of applications exists for HVAC systems. For example, residential, light commercial, commercial, and industrial systems are used to control temperatures and air quality in indoor environments and buildings. Generally, HVAC systems may utilize a filter, such as a high efficiency particulate air (HEPA) filter, to help purify, or clean, air travelling through the HVAC system. Over time, the filter may accumulate particulates, such as dust, from passing air and may be replaced as the filter becomes saturated with the particulates. However, certain filter security systems, or housing systems, may require excessive amounts of time to manufacture and assemble, as well as include complicated and time-consuming mechanisms to secure the filter within the HVAC system.

SUMMARY

In one embodiment of the present disclosure, a filter housing system of a heating, ventilating, and air conditioning (HVAC) system includes an enclosure configured to support a filter, a connecting channel disposed within a corner of the enclosure and coupled to the enclosure, and a locking system configured to couple to the connecting channel and configured to secure the filter within the enclosure. The locking system is configured to secure the filter within the enclosure via rotation of a screw.

In another embodiment of the present disclosure, a housing system for a heating, ventilating, and air conditioning (HVAC) system includes an enclosure configured to house a filter, a connecting channel having a first portion disposed within the enclosure and a second portion extending beyond the enclosure, and a locking system disposed within an end of the second portion of the connecting channel. The locking system is configured to apply pressure to the filter to secure the filter to the enclosure.

In a further embodiment of the present disclosure, a filter locking system for a heating, ventilating, and air conditioning (HVAC) system includes a bracket. The bracket includes a base, a first flange integrally coupled to the base and disposed generally perpendicularly to the base, and a second flange integrally coupled to the base and disposed generally perpendicularly to the base and to the first flange. The filter locking system also includes a nut configured to couple to the bracket within an aperture of the bracket, and a thumb screw configured engage with an inner surface of the nut.

Other features and advantages of the present application will be apparent from the following, more detailed description of the embodiments, taken in conjunction with the accompanying drawings, which illustrate, by way of example, the principles of the application.

DRAWINGS

DETAILED DESCRIPTION

The present disclosure is directed to a housing system configured to secure a filter within a heating, ventilating, and air conditioning (HVAC) system. More particularly, the housing system is configured to secure a high efficiency particulate air (HEPA) filter without the use of tools, such as hand tools. Moreover, the housing system may be manufactured and assembled without the use of welding or other complex machinery. That is, the housing system may be manufactured and assembled using riveting, screws, and v-grooving to reduce production costs and a number of operations associated with the manufacturing and assembly processes.

Figure 1:
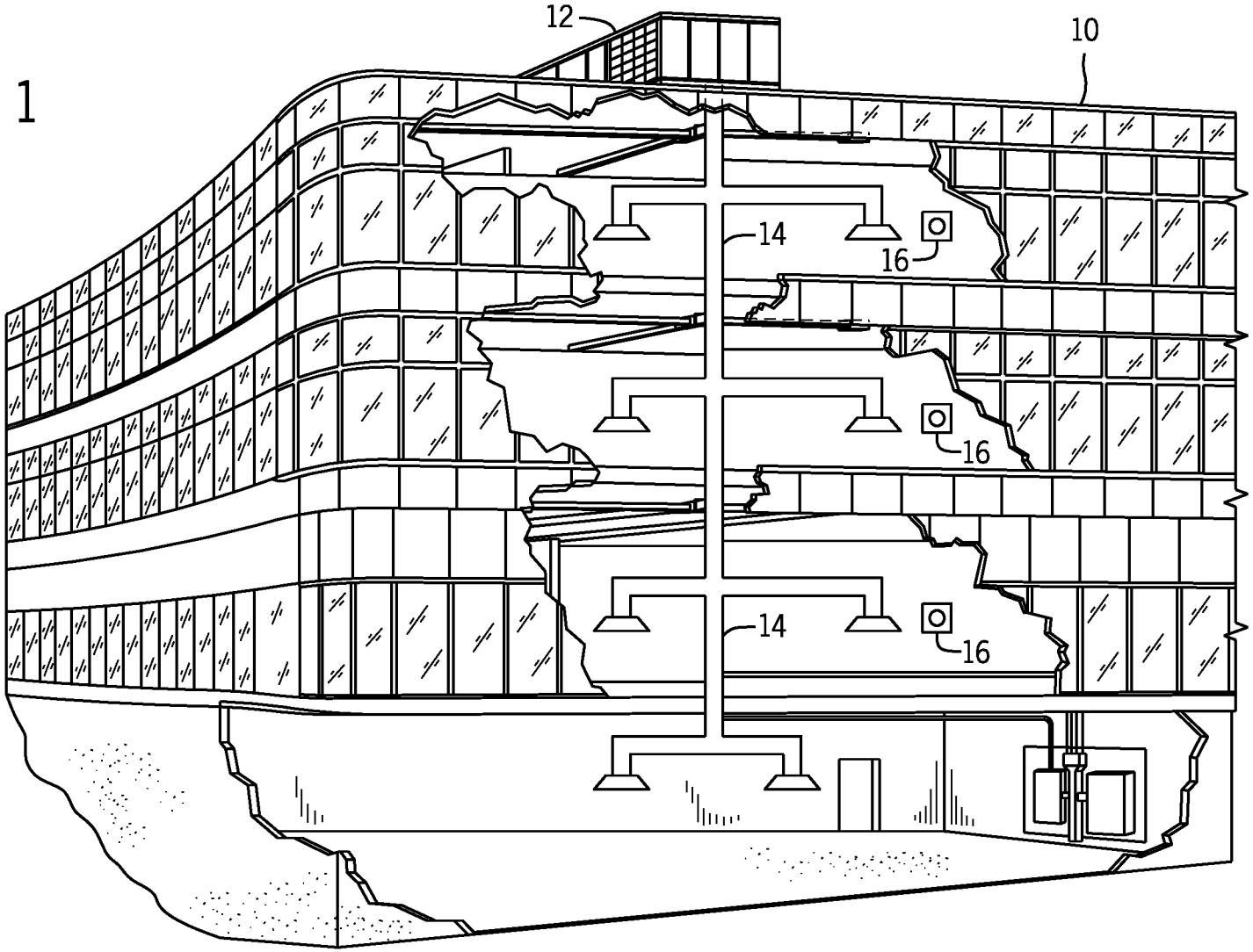
FIG. 1 is a perspective view of a heating, ventilating, and air conditioning (HVAC) system for building environmental management that may employ one or more HVAC units, in accordance with an embodiment of the present disclosure.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an airflow is passed to condition the airflow before the airflow is supplied to the building. In the illustrated embodiment, the HVAC unit 12 is a rooftop unit (RTU) that conditions a supply air stream, such as environmental air and/or a return airflow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
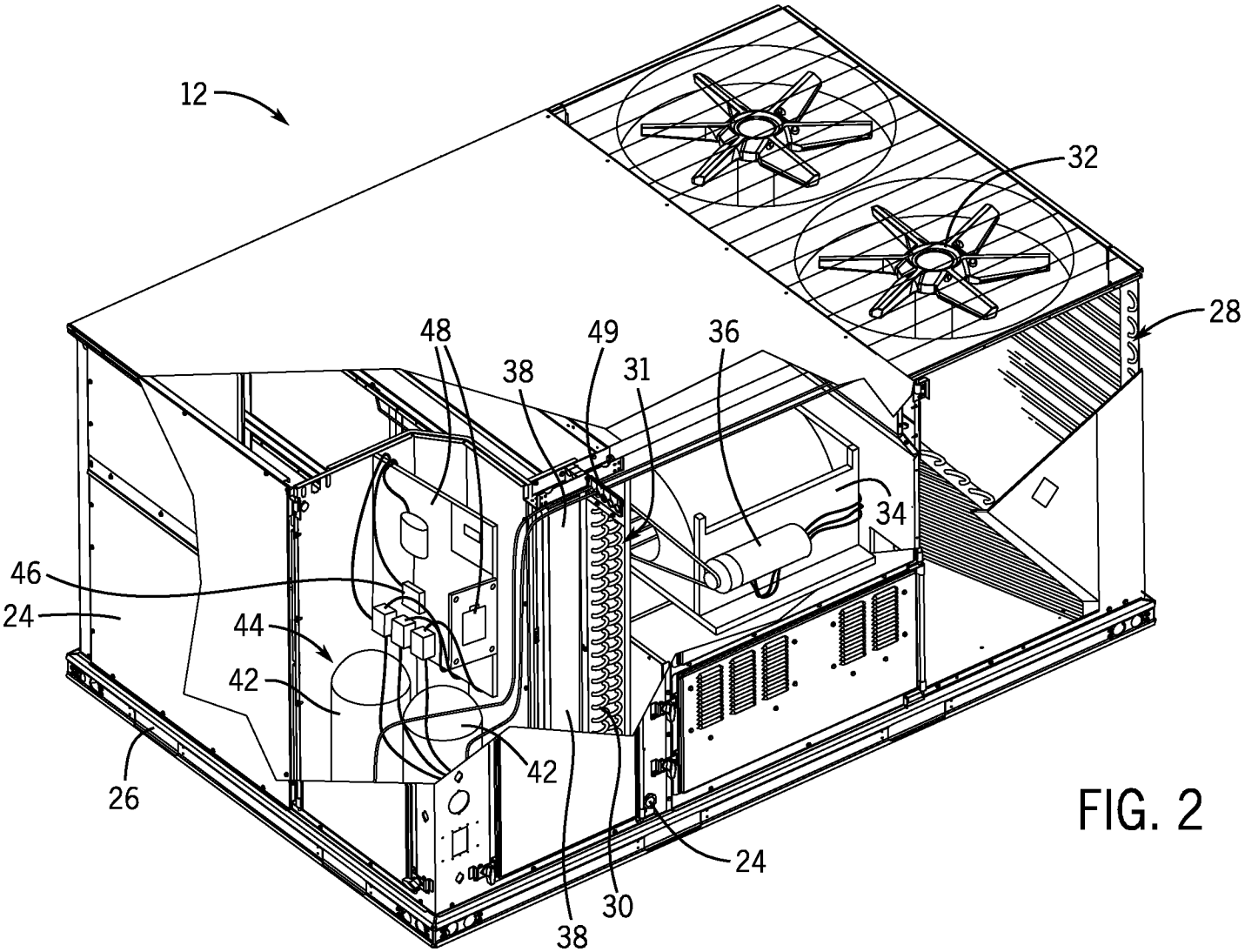
FIG. 2 is a perspective view of an HVAC unit of the HVAC system of FIG. 1, in accordance with an embodiment of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the airflows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned airflows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
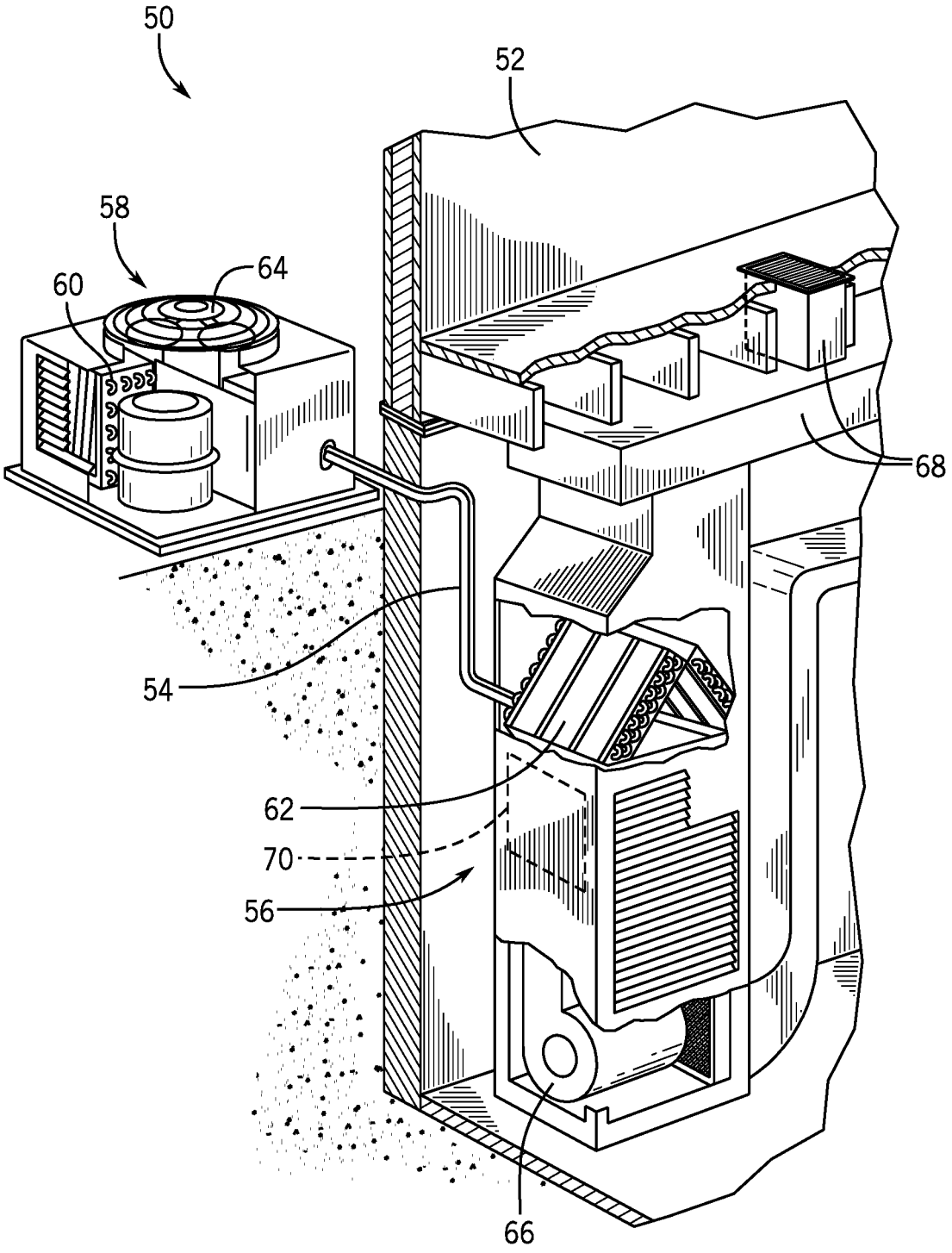
FIG. 3 is a perspective view of a residential split heating and cooling system, in accordance with an embodiment of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
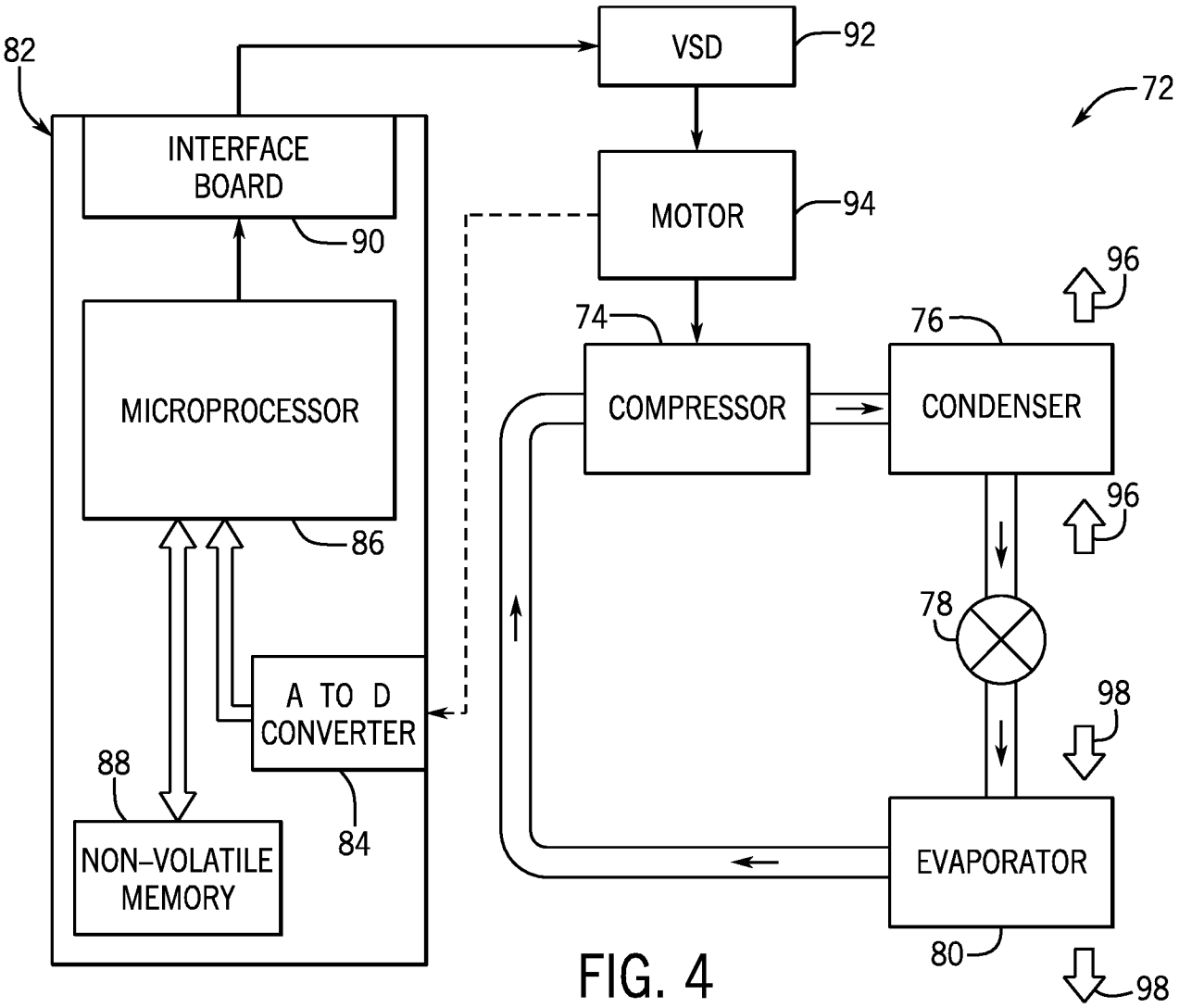
FIG. 4 is a schematic view of a vapor compression system that may be used in an HVAC system, in accordance with an embodiment of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed in detail below, HVAC systems, such as the HVAC unit 12 and the residential heating and cooling system 50, may include a filter, such as the filter 38 of the HVAC unit 12 (FIG. 2). In certain embodiments, a locking system may secure the filter within a housing system of the HVAC system.

Figure 5:
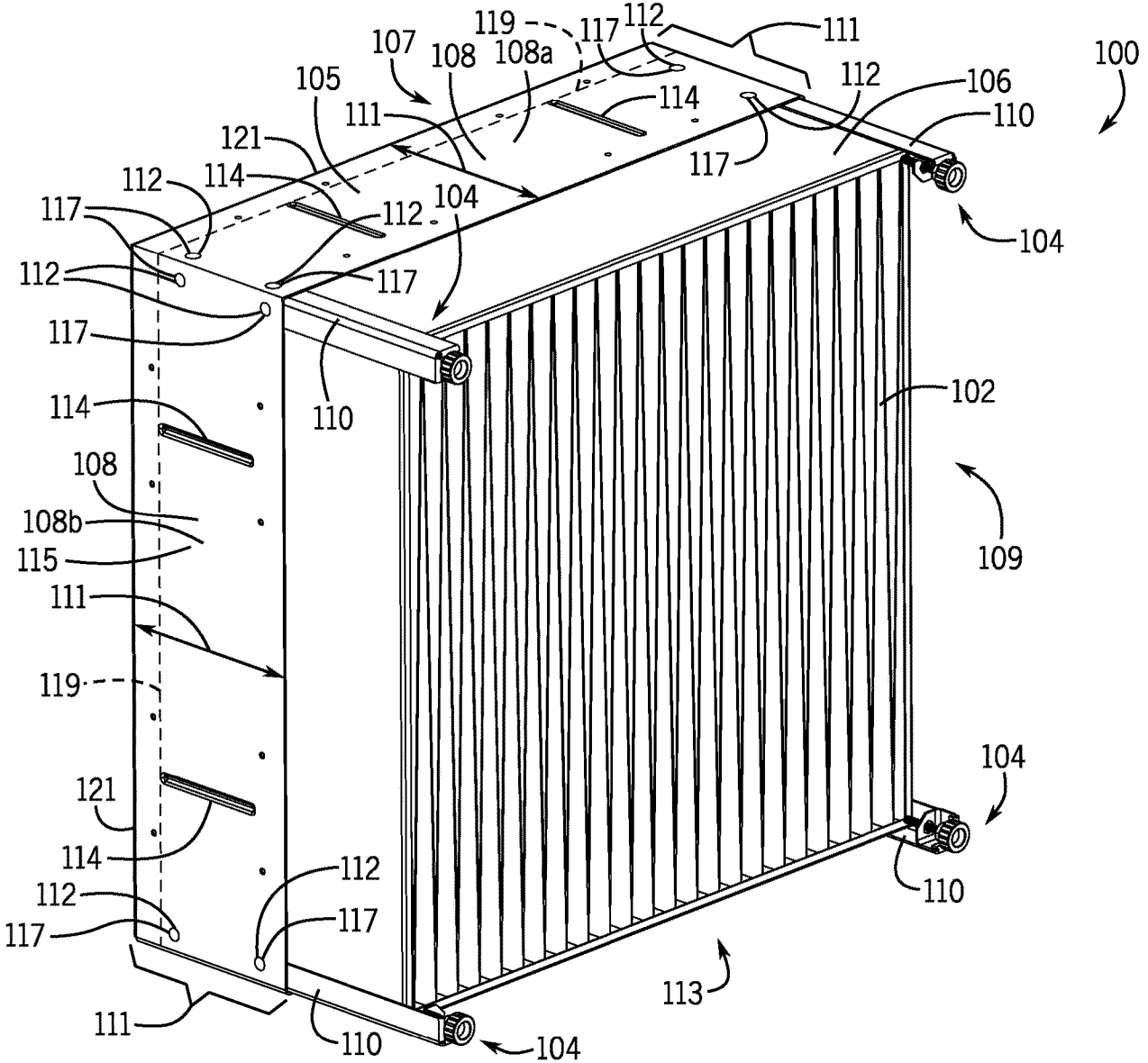
FIG. 5 is a perspective view of a filter within a housing system of the HVAC system of FIG. 1, in accordance with an embodiment of the present disclosure.

With the foregoing in mind, FIG. 5 illustrates a housing system 100 in which a filter 102 may be disposed and secured. Particularly, the filter 102 may be secured within the housing system 100 utilizing a locking system 104 of the housing system 100. The filter 102 may be any suitable filter having a rectilinear frame 106, or perimeter, as shown. In certain embodiments, the filter 102 may be a high efficiency particulate air (HEPA) filter configured to remove dust, debris, and other particles from air as it flows through an HVAC system, such as the HVAC unit 12.

First, it should be noted that, as discussed herein, "internal" surfaces of various elements of the housing system 100 may refer to surfaces of the elements that are closest to the filter 102 when the filter 102 is secured within the housing system 100. Similarly, as discussed herein, "external" surfaces of various elements of the housing system 100 may refer to surfaces of the elements that are on an opposite side of the "internal" surfaces, or to the surfaces that are furthest away from the filter 102 when the filter 102 is secured within the housing system 100.

The housing system 100 may further include an enclosure 107, which is composed of one or more panels 108 forming four sides, which include a first side 105, a second side 109, a third side 113, and a fourth side 115. That is, the panels 108 may be pieces of sheet metal that are bent to form more than one of the sides of the enclosure 107, or remain flat to each form one side of the enclosure 107. In certain embodiments, where the enclosure 107 includes multiple panels 108, the panels 108 may be coupled together via connecting channels 110, or L-channels. For example, the enclosure 107 may include four sides, as shown in the current embodiment, where two panels 108 are each bent along a width 111 to form two of the sides of the enclosure 107. More specifically, a first panel 108*a* may form the first side 105 and the second side 109, and a second panel 108*b* may form the third side 113 and the fourth side 115. As a further example, in certain embodiments, the enclosure 107 may be formed from a single panel 108 bent along its width 111 three times to form the four sides of the enclosure 107.

The connecting channels 110 may be coupled to internal surfaces of the corners of the enclosure 107 via fasteners 112. Indeed, the connecting channels 110 may couple, or connect, adjacent sides, or panels 108, of the enclosure 107. As shown, the connecting channels 110 may include a portion that is disposed within the enclosure 107 and a portion that extends beyond the enclosure 107. In certain embodiments, the width 111 of the enclosure 107 may be approximately half of the length of the connecting channels 110. The fasteners 112 may be rivets, screws, nuts and bolts, adhesives, welds, brazed metal, or the like. Specifically, external, or first, ends of the fasteners 112 may be disposed within countersunk holes 117 that are disposed within the external surface of the enclosure 107 while internal, or second, ends of the fastener 112 are disposed on internal surfaces of the connecting channels 110. That is, in certain embodiments, the second ends of the fasteners 112 may extend some distance toward the filter 102 from the internal surfaces of the connecting channels 110. Therefore, at least partially to provide clearance between the second ends of the fasteners 112 and the filter 102, the enclosure 107 may include one or more depressed portions 114, or v-grooves, configured to extend toward the filter 102 a distance that is further than the extension of the fasteners 112 toward the filter 102. More specifically, the depressed portions 114 of the enclosure 107 may serve to guide the filter 102 as the filter 102 is inserted into the enclosure 107 and to support the filter 102 once the filter 102 has been inserted into the enclosure 107. In certain embodiments, each side of the enclosure 107 may include one or more depressed portions 114 formed continuously along at least a portion of the width 111. Particularly, each side of the enclosure 107 may include one, two, three, four or any suitable number of depressed portions 114. Further, the depressed portions 114 may have been formed through a v-grooving process, embossing, stamping, or through any other suitable manufacturing technique that may result in the disclosed shape of the depressed portions 114.

Moreover, the enclosure 107 may include flanges 119 configured to provide a stop for the filter 102 when the filter 102 is inserted into the housing system 100, as discussed in further detail below. Particularly, the flanges 119 may extend from edges 121 substantially perpendicularly away from the external surfaces of the one or more panels 108. It should be noted that, while FIG. 5 has been simplified to show the flanges 119 as extending from the first side 105 and the fourth side 115, the flanges 119 may similarly extend from the second side 109 and the third side 113. When the filter 102 is inserted into the enclosure 107, the filter 102 may slide along the depressed portions 114 until the filter 102 reaches and contacts the flanges 119. In other words, in some embodiments, the filter 102 may only contact the enclosure 107 via the depressed portions 114 and the flanges 119.

As shown, the locking system 104 is configured to apply pressure to the frame 106 of the filter 102 to secure the filter 102 within the housing system 100. Indeed, in certain embodiments, the frame 106 may be formed from a substantially rigid material, such as a metal. As the locking system 104 applies pressure to the filter 102, the filter 102 may be biased against the flanges 119. Therefore, the filter 102 may experience a compressive force between the flanges 119 and the locking systems 104 while being supported by the depressed portions 114. In the current embodiment, the housing system 100 includes four locking systems 104, each coupled to respective locking channels 110. However, the housing system 100 may include any suitable number of locking systems 104 coupled to a corresponding amount of locking channels 110.

Figure 6:
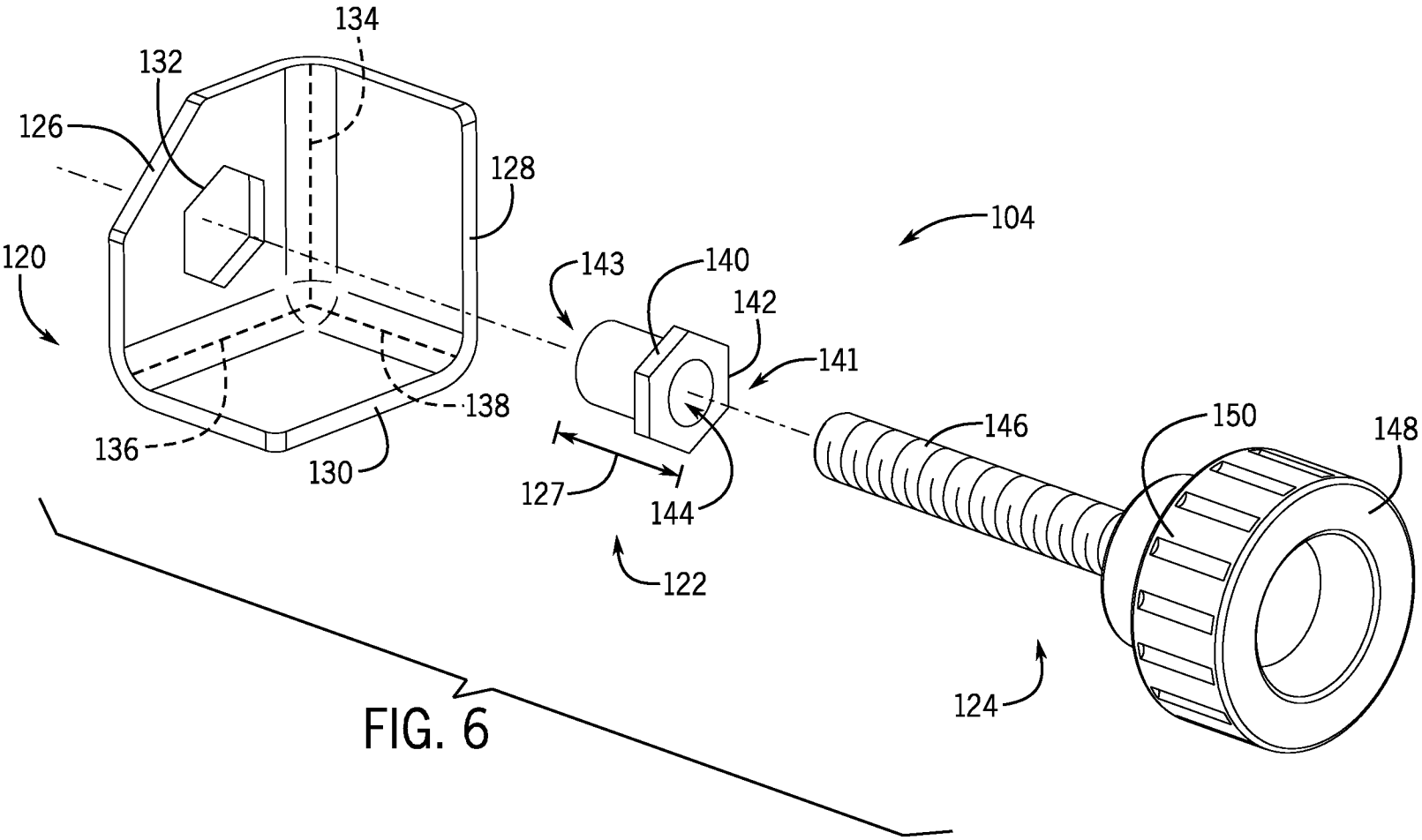
FIG. 6 is a perspective view of a locking system of the housing system of FIG. 5, in accordance with an embodiment of the present disclosure.

FIG. 6 illustrates an embodiment of the locking system 104 which may be disposed within the locking channel 110. The locking system 104 includes a bracket 120, a nut 122, and a screw 124. The bracket 120 includes a base 126, a first flange 128, and a second flange 130, which are all disposed generally perpendicularly relative to one another. The bracket 120 may be formed via bending of a flat piece of metal along a first bend 134 and along a second bend 136, such that edges of the first and second flanges 128, 130 are disposed substantially along a line 138. That is, in certain embodiments, the first and second flanges 128, 130 may be in at least partial contact along the line 138. Alternatively, the first and second flanges 128, 130 may be disposed directly adjacent to each other along the line 138 while maintaining a gap along the line 138. In certain embodiments, the first and second flanges 128, 130 may be coupled, such as via welding, along the line 138. Further, in certain embodiments, the first and second flanges 128, 130 may be solid. In other words, the first and second flanges 128, 130 may not contain interior holes.

Further, the base 126 may include an aperture 132 configured to receive the nut 122. For example, the aperture 126 may be hexagonally shaped and the nut 122 may be a correspondingly shaped hex nut. However, the aperture 126 may include any suitable polygonal shape with the nut 122 having a corresponding polygonal shape. Indeed, the nut 122 may include a polygonal portion 140 which may extend partially along, or throughout, a length 127 of the nut 122. Further, the nut 122 may be a rivet whereby a first end 141 of the nut 122 includes a lip 142, or head, configured to abut against a surface of the base 126, while a second end 143 of the nut 122 is configured to be set, or peened, to create a ridge, or head, to abut against an opposite surface of the base 126 once the nut 122 is inserted within the aperture 132.

The nut 122 also includes a threaded bore 144 configured to receive the screw 124 via a threaded shaft 146, which is rigidly and integrally coupled to a knob 148 of the screw 124. As discussed herein, the locking system 104 is configured to secure the filter 102 (FIG. 5) within the housing system 100 without the use of tools, such as specialized tools. Accordingly, the knob 148 may include a textured surface 150 configured to promote frictional forces. For example, an operator may easily grip the knob 148 and rotate the screw 124 to couple the screw 124 to the nut 122. That is, in certain embodiments, the screw 124 may be a thumb screw. Further, in some embodiments, the screw 124 may be a machine screw, a threaded bolt, or any other suitable fastener.

Figure 7:
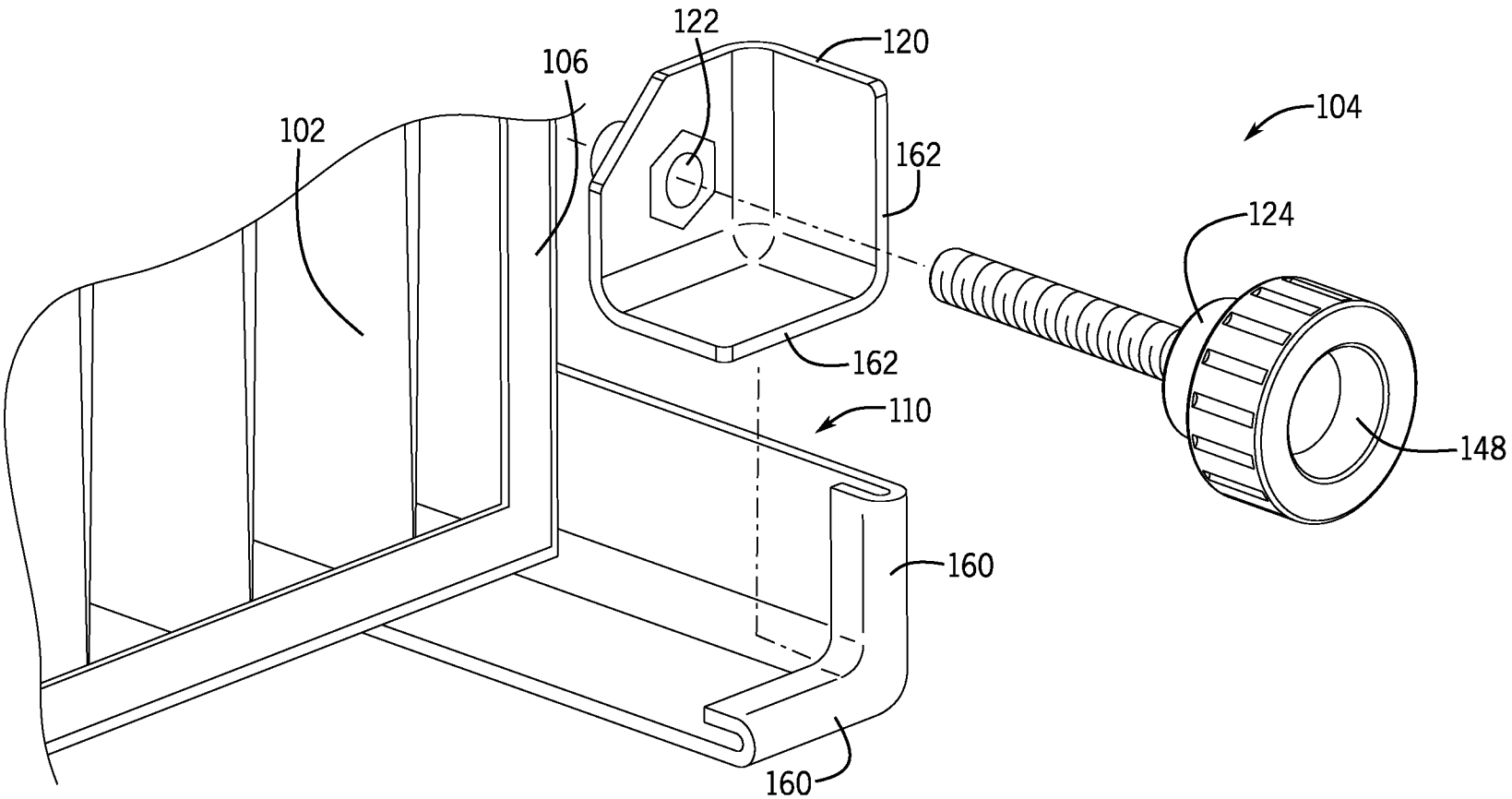
FIG. 7 is a perspective view of a locking system of the housing system of FIG. 5, in accordance with an embodiment of the present disclosure.
Figure 8:
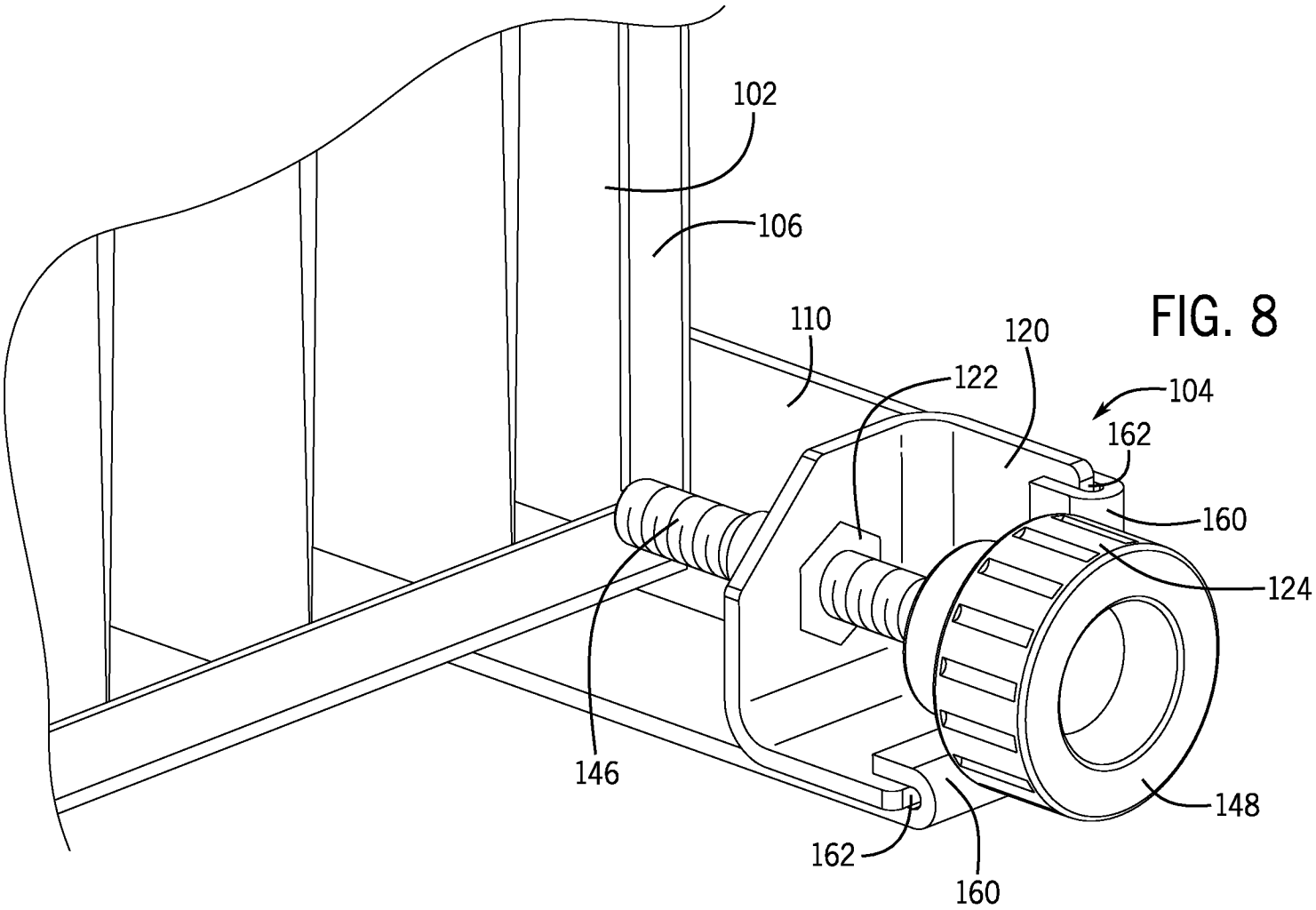
FIG. 8 is a perspective view of a locking system of the housing system of FIG. 5, in accordance with an embodiment of the present disclosure.

FIG. 7 illustrates an embodiment of the locking system 104 with the nut 122 rigidly coupled to the bracket 120. As shown, the connecting channel 110 may include a hemmed portion 160 configured to receive the bracket 120. Indeed, as shown in FIG. 8, which will now be discussed in parallel with FIG. 7, top edges 162 of the bracket 120 are configured to be received within the hemmed portion 160. In certain embodiments, the bracket 120 may be coupled to the connecting channel 110 within the hemmed portion 160 via press fitting, snap fits, welding, gluing, fasteners, or any other suitable coupling means. In certain embodiments, as discussed in further detail below, the bracket 120 may simply be placed to rest within the hemmed portion 160. Before, at the same time, or after the bracket 120 has been inserted within the hemmed portion 160, the screw 124 may be inserted into the nut 122 as described above. The screw 124 may continually be rotated until the threaded shaft 146 is abutting against the frame 106 of the filter 106. In certain embodiments, the locking system 104 may include a stop 161 configured to limit the amount that the screw 124 can extend toward the filter 102, thereby also limiting the pressure that the screw 124 can apply to the filter 102. In certain embodiments, amount that the screw 124 can extend toward the filter 102 may be limited due to the length of the screw, which may be augmented depending on the size of the filter.

Once the screw 124 has been rotated such that the threaded shaft 146 is contacting the frame 106, the screw 124 may be further rotated to increase a force of the threaded shaft 146 against the frame 106. Particularly, an operator may further torque the knob 148 of the screw 124 by using their hand to directly grip and rotate the knob 148 of the screw 124. As the force of the threaded shaft 146 against the frame 106 increases, a force of the bracket 120 against the hemmed portion 160 of the connecting channel 110 may similarly increase. Indeed, when the locking system 104 is assembled, the bracket 120 may be simply placed within the hemmed portion 160, and securing the filter 102 will also further secure the bracket 120 within the hemmed portion 160 through reactive forces from the screw 124 pressing against the frame 106 of the filter 102.

Accordingly, the present disclosure is directed to providing systems and methods for manufacturing and assembling a housing system for a filter within an HVAC system as well as simplified installation and removal of the filter to and from the housing system. The housing system may be manufactured and assembled through a reduced number of operations and provides for installation and removal of the filter without the use of tools.

While only certain features and embodiments of the present disclosure have been illustrated and described, many modifications and changes may occur to those skilled in the art, such as variations in sizes, dimensions, structures, shapes and proportions of the various elements, values of parameters, mounting arrangements, use of materials, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the embodiments, all features of an actual implementation may not have been described, such as those unrelated to the presently contemplated best mode of carrying out the disclosure, or those unrelated to enabling the claimed features. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A filter housing system of a heating, ventilating, and air conditioning (HVAC) system, comprising:

an enclosure comprising a plurality of sides configured to receive a filter having a frame, a first end, and a second end opposite the first end, wherein the enclosure is configured to enclose a perimeter of the first end;

a connecting channel coupled to at least one side of the plurality of sides of the enclosure and extending outward from the enclosure, wherein an end portion of the connecting channel is configured to extend beyond the filter received by the enclosure, the at least one side of the plurality of sides of the enclosure comprises an internally-facing surface, the connecting channel is coupled to the internally-facing surface, and the internally-facing surface and the connecting channel are each configured to engage with the filter; and a locking system configured to couple to the connecting channel at the end portion, wherein the locking system comprises a screw extending through an aperture of the locking system and configured to extend toward the enclosure and apply pressure to the second end of the filter extending beyond the enclosure to secure the filter in engagement with the enclosure via rotation of the screw.

2. The filter housing system of claim 1, wherein the connecting channel is coupled to the at least one side via a rivet.

3. The filter housing system of claim 2, wherein the rivet is disposed within a counter-sunk hole disposed within an external surface of the enclosure.

4. The filter housing system of claim 1, wherein the plurality of sides comprises:

a first side and a second side formed from a first continuous panel; and a third side and a fourth side formed from a second continuous panel, wherein the connecting channel is coupled to the first continuous panel and to the second continuous panel.

5. The filter housing system of claim 1, wherein the end portion of the connecting channel comprises a hemmed portion, and the locking system is configured to fit within the hemmed portion.

6. The filter housing system of claim 1, wherein the screw is arranged and configured to apply pressure to the frame of the filter to secure the filter within the enclosure.

7. The filter housing system of claim 1, wherein the at least one side of the plurality of sides comprises an externally-facing surface opposite the internally-facing surface and comprises a depressed portion formed in the externally-facing surface such that a portion of the internally-facing surface of the at least one side of the plurality of sides of the enclosure extends inwardly towards the filter received by the enclosure to form a guide configured to support the filter during installation of the filter.

8. The filter housing system of claim 1, wherein the locking system comprises a bracket, a nut, and the screw.

9. The filter housing system of claim 8, wherein the nut is a rivet nut configured to be coupled to the bracket via riveting.

10. The filter housing system of claim 8, wherein the screw is configured to apply direct force to the filter to secure the filter within the filter housing system.

11. The filter housing system of claim 1, wherein the screw is a thumb screw.

12. The filter housing system of claim 1, comprising the filter.

13. The filter housing system of claim 12, wherein the filter is a high efficiency particulate air (HEPA) filter.

14. The filter housing system of claim 1, wherein the internally-facing surface of the at least one side of the plurality of sides is configured to extend along a corresponding side of the frame of the filter in an installed configuration of the filter in the enclosure, and the connecting channel is configured to engage with the corresponding side of the frame of the filter in the installed configuration.

15. The filter housing system of claim 1, wherein the locking system comprises a bracket, and the connecting channel comprises an internal surface configured to engage with the filter and the bracket of the locking system.

16. The filter housing system of claim 15, wherein the internal surface of the connecting channel is configured to engage with a corner of the filter, and the bracket is configured to extend crosswise from the internal surface of the connecting channel and overlap with the filter in an installed configuration of the filter in the enclosure.

* * * * *